US005417002A

United States Patent [19]

Guerra

[11] Patent Number: 5,417,002

[45] Date of Patent: May 23, 1995

[54] ADJUSTABLE FIREARM HANDLE

[76] Inventor: Jorge E. Guerra, 210 Palm Cir., Laredo, Tex. 78041

[21] Appl. No.: 228,351

[22] Filed: Apr. 15, 1994

[51] Int. Cl.[6] ..... F41C 23/16

[52] U.S. Cl. ..... 42/72; 42/73; 89/1.42

[58] Field of Search ..... 42/73, 72, 71.01, 94; 89/1.42

[56] References Cited

U.S. PATENT DOCUMENTS

| | | | |
|---|---|---|---|
| 961,511 | 6/1910 | Marble | 42/72 |
| 1,585,249 | 5/1926 | Johns | 42/71.01 |
| 2,771,697 | 11/1956 | Reising | 42/71.01 |
| 2,826,848 | 3/1958 | Davies | 42/71.01 |
| 3,938,273 | 2/1976 | Tellie | 42/94 |
| 4,502,238 | 3/1985 | Farrar et al. | 42/72 |
| 5,027,542 | 7/1991 | Simonetti | 42/72 |
| 5,068,992 | 12/1991 | Velezis et al. | 42/72 |

FOREIGN PATENT DOCUMENTS

| | | | |
|---|---|---|---|
| 280996 | 12/1914 | Germany | 42/72 |
| 93822 | 4/1960 | Netherlands | 42/71.01 |
| 106412 | 5/1917 | United Kingdom . | |

*Primary Examiner*—Stephen M. Johnson
*Attorney, Agent, or Firm*—Richard C. Litman

[57] ABSTRACT

The present invention is a handle assembly for removable attachment to the forearm portion of a firearm. It includes a handle, whose position relative to the forearm portion, may be readily adjusted to one of a plurality of locations. A push button mechanism actuates movement of a locking mechanism which secures the handle at the chosen location. When the handle is locked into any one of the positions, it is held securely, and therefore does not detract from the accuracy of the weapon.

10 Claims, 4 Drawing Sheets

ADJUSTABLE FIREARM HANDLE

BACKGROUND OF THE INVENTION

1. FIELD OF THE INVENTION

The present invention relates to a handle for attachment to the forearm portion of a firearm. Specifically, the invention relates to a handle adjustable between a plurality of angularly spaced mounting positions.

2. DESCRIPTION OF THE PRIOR ART

Auxiliary handles for attachment to firearms are well known in the prior art. British Pat. No. 106,412 issued to Charles L. Woodward on May 24, 1917, discloses a handle attachable to a firearm, to make that firearm usable by a person who has either partially or completely lost the use of one hand. This handle comprises a gripping portion configured to have a plurality of recesses for receiving the user's fingers. When the gripping portion is attached immediately behind the trigger guard, the user can maintain the gun in a firing position by holding the gripping portion and balancing the gun. The user's index finger can then be utilized to pull the trigger.

Handles have also been designed for attachment to pump action guns. One such handle is disclosed in U.S. Pat. No. 5,027,542 issued to Michael P. Simonetti on Jul. 2, 1991. This handle is U-shaped in design, and it is immovably secured to the underside of a forearm stock which is slidable upon a magazine. Two substantially vertical portions each have one of their ends connected to the forearm stock. The other ends of the vertical portions are connected to each other by a substantially horizontal portion. Together, the horizontal portion and the two substantially vertical portions create a U-shaped handle. The horizontal portion of the handle may is grasped when carrying out the pumping action of the forearm stock.

Other handles designed specifically for attachment to pump action guns are disclosed in U.S. Pat. No. 2,771,697 issued to Harry A. Reising on Nov. 27, 1956, U.S. Pat. No. 2,826,848 issued to Thomas E. Davies on Mar. 18, 1958, U.S. Pat. No. 4,502,238 issued to Jack R. Farrar, et al. on Mar. 5, 1985, and U.S. Pat. 5,068,992 issued to George A. Velezis, et al. on Dec. 3, 1991. All of these patents include a handle having an adjustable position in relation to the forearm stock.

The handle shown in the Reising patent is of a generally Y-shaped configuration formed from an elongated handle and a pair of oppositely disposed arm portions. These arm portions are configured to extend around, and grip, the perimeter of the forearm of the gun. A bolt, extending through both of the arm portions, controls the strength of the grip, thus permitting each user to manipulate the bolt to secure the handle at any desired position.

The handle depicted in the Davies patent includes a tubular gripping portion and a pair of scoops threadedly secured within one end of the tube. These scoops are for encircling a portion of the forearm of the gun. When the scoops are secured within the end of the tube, they are held securely around the perimeter of the forearm, thus maintaining the position of the gripping portion. When the scoops are detached from the tube, their position relative to the forearm may be changed, with the subsequent re-threading of the scoops securing this new position.

The Farrar et al. patent shows a handle assembly for use with a pump action gun. This assembly includes a forend element for mounting upon the magazine of the gun. This forend element includes a shoulder at its rear end and threads at its forward end. A ring is fastened to the threads to secure a tube between the ring and the shoulder. Rotatably connected to this tube is a handle securable at any one of a plurality of gripping positions. A spring pressed detenting element, attached to the handle, mates into one of a plurality of notches formed in a collar secured to the tube. This spring pressed detenting element releasably retains the selected positioning of the handle. When the handle is rotated axially, the spring pressed detenting element is pulled away from the notches, thus permitting the handle to be repositioned relative to the forend element.

In the Velezis et al. patent, there is disclosed a forearm assembly for a firearm. This forearm assembly includes a tubular forearm for placement over the magazine portion of the firearm. A handle mates with this tubular forearm in a manner permitting a bolt extending axially through the handle to mate with one of a plurality of threaded openings in the forearm.

None of the above inventions and patents, taken either singly or in combination, is seen to describe the instant invention as claimed.

SUMMARY OF THE INVENTION

The present invention is an adjustable handle assembly usable with a plurality of firearms. It comprises first and second rings, each of which securely attach to the forearm or magazine portion of a firearm. Positioned between these rings is a handle having a gripping portion and a guide member. This guide member extends into a guide channel, in each of the rings, to permit the handle to be radially movable around the forearm portion of the gun.

A pair of locking bars are attached to the handle, and are utilized to prevent movement of the handle relative to the rings. The first locking bar is extendable into and retractable from one notch of a plurality of notches in the first ring. Likewise, the second locking bar is extendable into and retractable from one notch of a plurality of notches in the second ring. The extension and retraction of each locking bar is controlled by a spring loaded push button, positioned proximate to the location of the user's index finger.

Accordingly, it is a principal object of the invention to provide a novel handle assembly wherein the positioning of the handle may be readily adjusted.

It is another object of the invention to provide a novel handle assembly wherein the handle may be quickly and securely locked in any one of a plurality of gripping positions.

It is a further object of the invention to provide a novel handle assembly having a push button for both securing and unlocking the positioning of the handle.

Still another object of the invention is to provide a novel handle assembly adaptable for use with a plurality of firearms.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
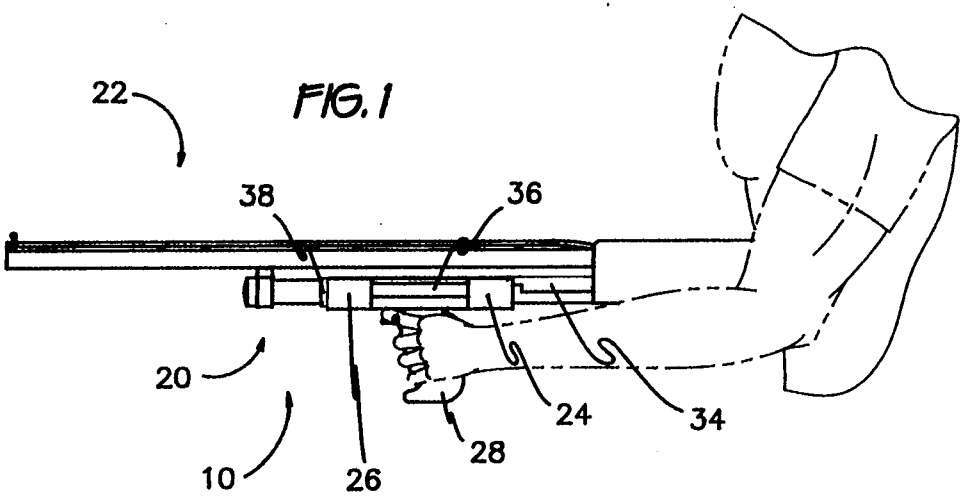
FIG. 1 is a side elevational view of the handle assembly of the invention attached to the magazine portion of a slide action firearm.
Figure 2:
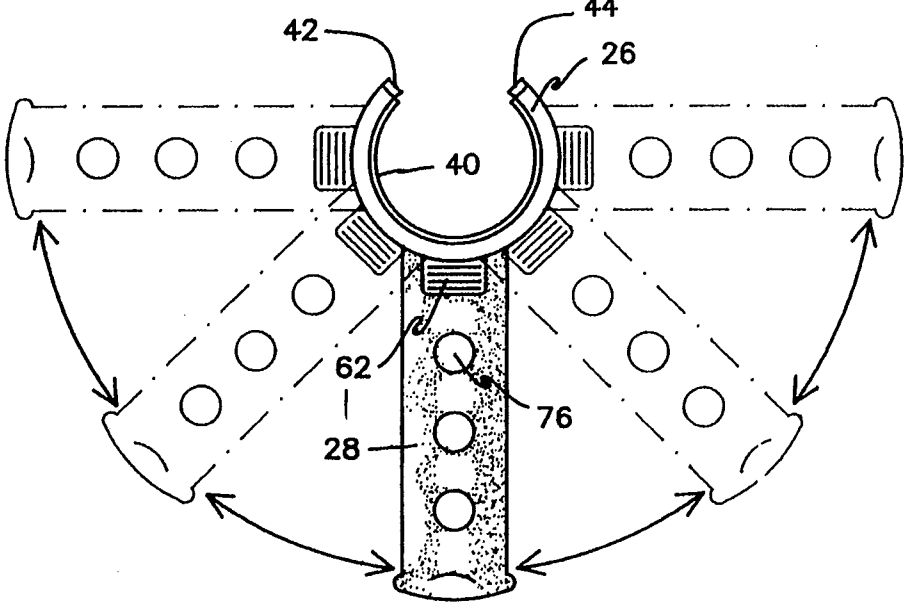
FIG. 2 is an enlarged scale, front elevational view of the second ring of the handle assembly of FIG. 1.

As illustrated in FIG. 1, the present invention is a handle assembly 10 for attachment to the forearm portion 20 of a firearm 22. This assembly 10 is well suited for slide action guns 22, but it is also usable with any firearm possessing a sufficient forearm portion. Included in assembly 10 is a first ring 24, a second ring 26, and a handle 28 secured therebetween. Handle 28 is adjustable between rings 24,26, permitting the user to customize the position of handle 28 to suit his or her particular needs. Possible positions of handle 28, are depicted in FIG. 2.

Figure 3:
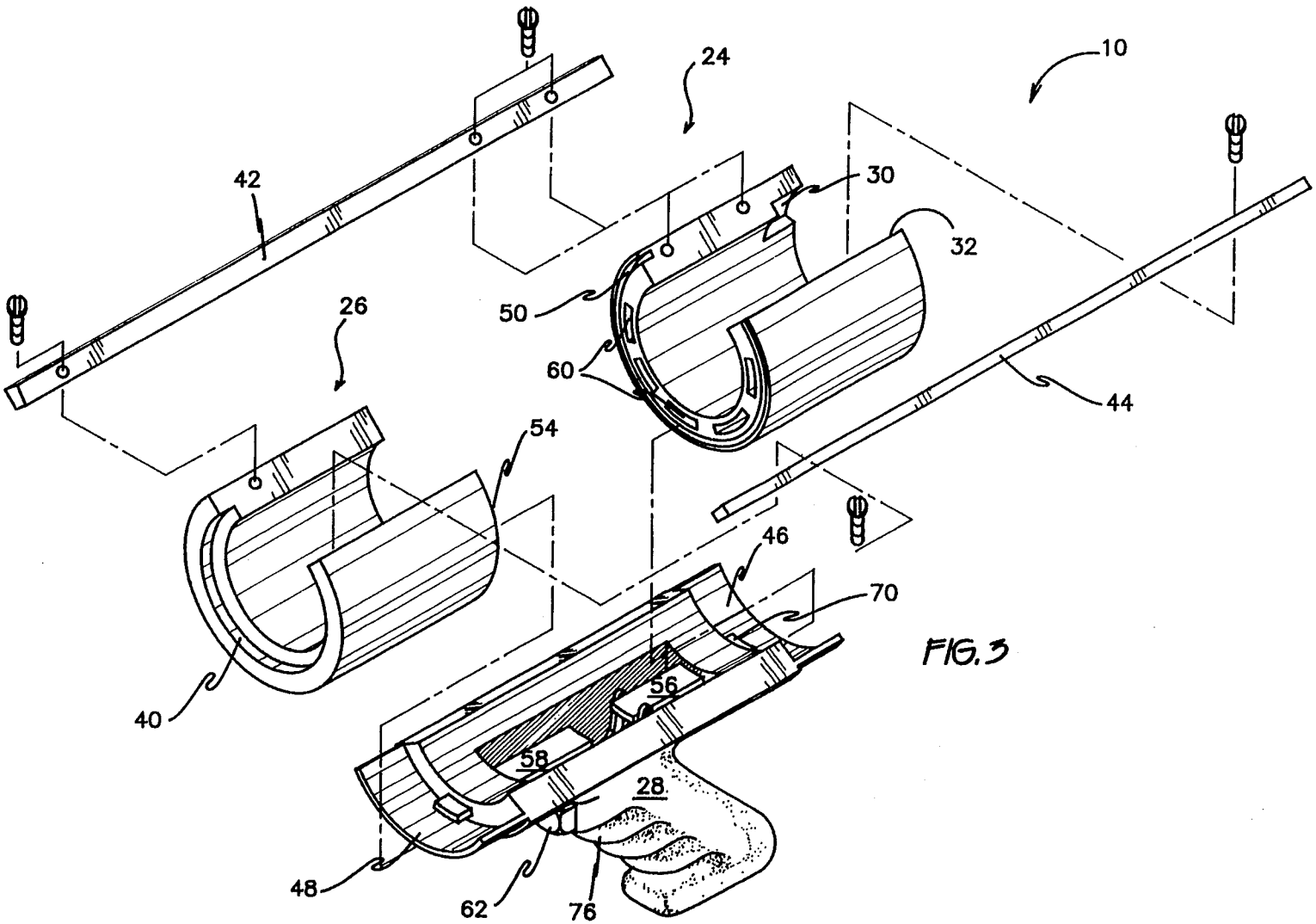
FIG. 3 is an exploded, enlarged scale, perspective view of the handle assembly of FIG. 1.

Handle assembly 10 is configured for attachment to many standard weapons, such as slide action firearm 22. As shown in FIG. 3, first ring 24 includes a first recessed portion 30 and a similar, but opposite, second recessed portion (not shown) located at 32. These recessed portions are each for receiving the ends of a standard action bar 34, shown in FIG. 1. When the ends of action bar 34 are within the respective recessed portions, first ring 24 is prevented from rotating around the perimeter of the slidable exterior pipe 36.

The entire assembly 10 is clamped against action bar 34 by a threaded washer 38, which, along with the action bar 34, is a standard component on most slide action guns. Washer 38 fits snugly inside a circular depression 40, shown in FIG. 3. The tight fit between washer 38 and circular depression 40 prevents lateral movement of second ring 26. The distance bars 42,44, which rigidly interconnect second ring 26 to first ring 24, prevent axial movement of second ring 26 around external pipe 36. Thus, the assembly including handle 28, rings 24,26, distance bars 42,44, and the unmodified, standard external pipe 36, comprise the modified slide action of this invention.

The adjustability of handle 28 arises from the manner in which handle 28 is held between first ring 24 and second ring 26. As shown in FIG. 3, the top of handle 28 includes a rear guide member 46 and a front guide member 48. Rear guide member 46 is for placement within a guide channel 50, formed radially within first ring 24. Front guide member 48 is for placement within a guide channel, formed within surface 54 of second ring 26. Although the guide channel of second ring 26 is not shown, it is similarly configured to guide channel 50 of first ring 24. When rear guide member 46 and front guide 48 are each positioned inside the appropriate guide channels, handle 28 is permitted to freely rotate around a portion of exterior pipe 36.

First and second locking bars 56,58 are utilized to secure handle 28 at any one of the plurality of positions shown in FIG. 2. These locking bars 56,58 are configured so first locking bar 56 extends in the direction of first ring 24, and second locking bar 58 extends in the direction of second ring 26. When handle 28 is locked into a specific position, first locking bar 24 protrudes into one of the notches 60 in first ring 24, and second locking bar 58 protrudes into a similar notch in surface 54 of second ring 26. When handle 28 is not locked into a specific position, each of the locking bars 56,58 are retracted away from the notches, permitting adjustment of handle 28.

Figure 4:
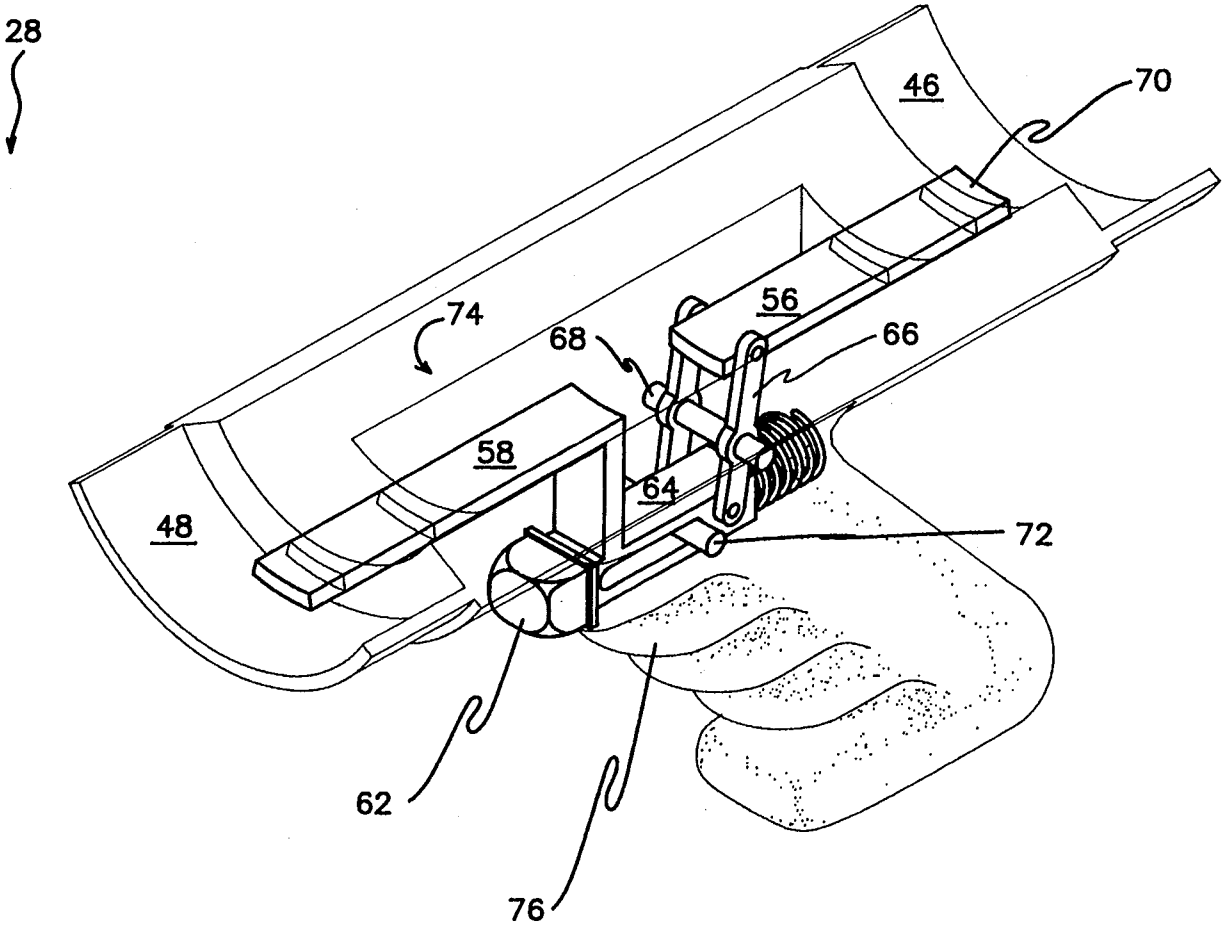
FIG. 4 is an enlarged scale, perspective view of the handle of the invention, showing the internal locking mechanism in the locked position.
Figure 5:
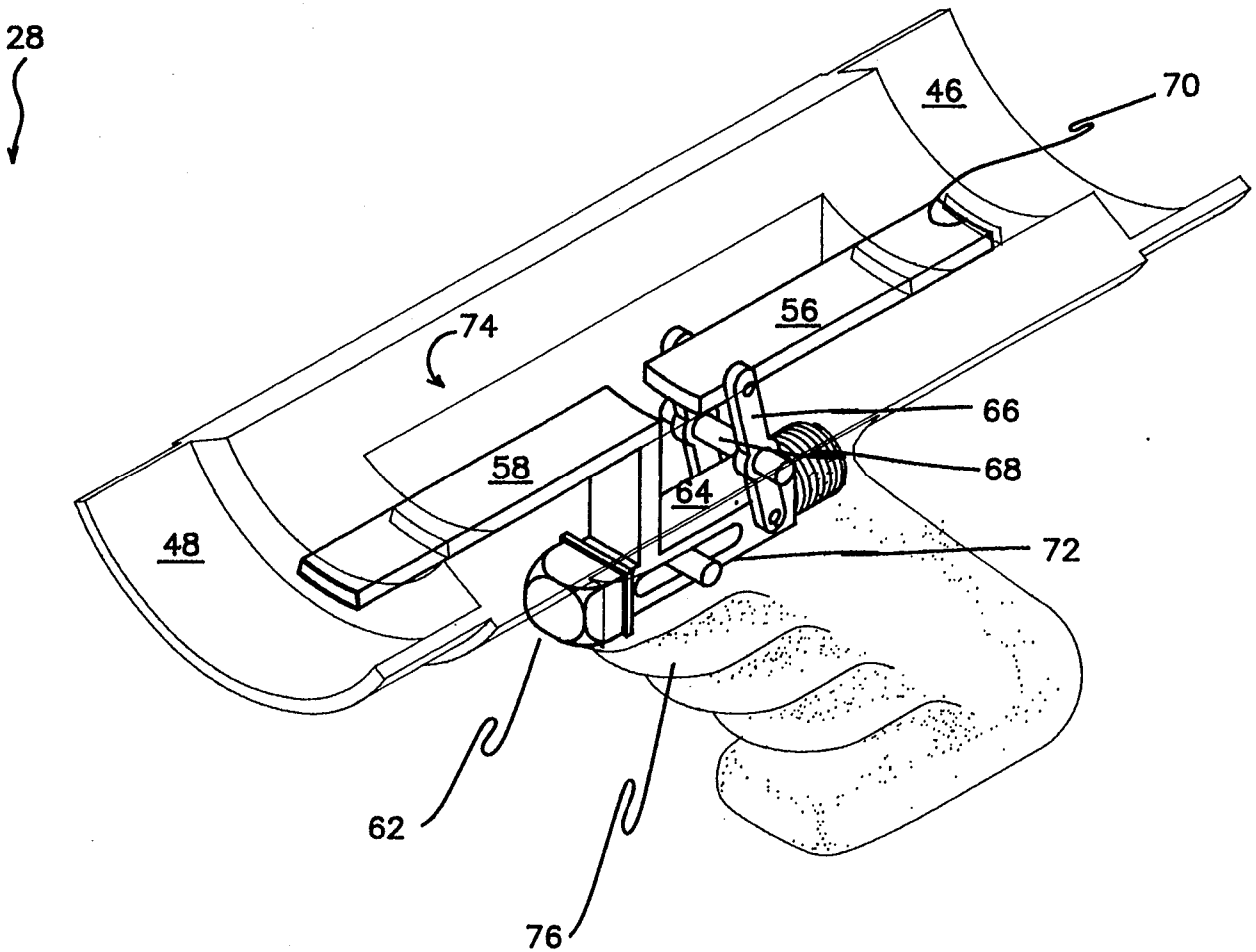
FIG. 5 is an enlarged scale, perspective view of the handle of the invention, showing the internal locking mechanism in the unlocked position.

The extension and retraction of locking bars 56,58 is controlled by the spring loaded push button 62, depicted most clearly in FIGS. 4 and 5. Locking bar 58 is rigidly secured to push button body 64. Therefore, displacement of push button body 64 corresponds to a displacement of locking bar 58, in the same direction as the movement of push button body 64. The movement of locking bar 56, on the other hand, is counter to the movement of push button body 64. Element 66 of locking bar 56 is hingedly secured to body 64. When body 64 is moved by either pushing or releasing button 62, element 66 is pivoted about the pin 68, and end 70 is displaced in a direction opposite to the direction of movement of body 64.

Therefore, when push button 62 is depressed, locking bars 56,58 are retracted away from the notches. This unlocked position is shown in FIG. 5, where locking bars 56,58 are depicted to be retracted within the top portion of handle 28. When push button 62 is released, locking bars 56,58 extend outward from handle 28 and protrude into the notches that have been appropriately aligned thereto. This locked position of handle 28 is illustrated in FIG. 4.

The positioning of the notches within each ring 24,26, dictates potential securable locations of handle 28. In the figures, notches 60 are arranged at approximately 45 degree intervals, which permits handle 28 to be securable at the positions shown in FIG. 2. However, as the needs of each user vary, rings 24,26 may be manufactured with notches separated by any distance. Additionally, each ring 24,26 may include any number of notches, as long as the notches of each ring 24,26 are configured to simultaneously accept the appropriate locking bar 56,58.

The arrangement of a locking bar 56,58 on either side of handle 28 affords great stability to handle 28 when it is in its locked position. The two spaced locking bars 56,58 prevent virtually all undesired movement of handle 28. In situations where there is only one locking mechanism, as shown in the prior art, there is a likelihood that areas of the handle remote from the locking bar, will not be completely stable, and therefore experience play when the weapon is utilized. For example, if the locking mechanism is positioned at the front of the handle, the rear of the handle may be permitted to slightly sway when the weapon is fired. As even the slightest of movement can substantially affect the accuracy of the weapon, this is a highly undesirable configuration.

Stability of handle 28 is also achieved from pin 72. In addition to limiting the distance button 62 can be depressed, pin 72 prevents the locking mechanism 74 from rotating relative to handle 28. This guarantees the preciseness of the positioning of locking bars 56,58, assuring that they efficiently extend into the notches upon releasing push button 62.

To prevent accidental unlocking of handle 28 by inadvertent depressing of button 62, the push button 62 is raised slightly away from the surface of handle 28. Therefore, although button 62 is located proximate to the index finger indentation 76 of handle 28, the user must extend his or her index finger to reach button 62. As this is a somewhat awkward position in terms of holding or firing weapon 22, it is unlikely that a user will inadvertently rest his or her index finger upon push button 62. With the index finger remote from button 62, the possibility of an accidental unlocking of handle 28 is diminished.

It is to be understood that the present invention is not limited to the sole embodiment described above, but encompasses any and all embodiments within the scope of the following claims.

I claim:

1. A handle assembly for use with a firearm, comprising:

a first ring and a second ring dimensioned and configured for stationary attachment to said firearm, said first ring having a guide channel therein;

a handle having a top portion with a guide member, said guide member for placement within said guide channel of said first ring, each of said first ring and said second ring being positioned on an opposed side of said handle, thereby allowing said handle to be radially movable in relation to said first ring and said second ring; and a locking means for preventing movement of said handle relative to said first ring and said second ring.

2. The handle assembly according to claim 1, wherein said first ring includes a plurality of notches, said locking means comprising:

at least one locking bar secured to said handle, said at least one locking bar being separately alignable with each notch of said plurality of notches; and means for selectively extending a portion of said at least one locking bar into any one notch of said plurality of notches.

3. The handle assembly according to claim 2, wherein said means for selectively extending comprise a spring loaded push button.

4. The handle assembly according to claim 1, further including at least one distance bar connecting said first ring to said second ring.

5. The handle assembly according to claim 1, wherein said first ring includes a first plurality of notches and said second ring includes a second plurality of notches, said locking means comprising:

a first locking bar movably secured to said handle, said first locking bar being separately alignable with each notch of said first plurality of notches;

means for selectively extending a portion of said first locking bar into any one notch of said first plurality of notches;

a second locking bar movably secured to said handle, said second locking bar being separately alignable with each notch of said second plurality of notches; and means for selectively extending a portion of said second locking bar into any one notch of said second plurality of notches.

6. The handle assembly according to claim 5, wherein both said means for selectively extending a portion of said first locking bar and said means for selectively extending a portion of said second locking bar, comprise a spring loaded push button.

7. A handle assembly for use with a firearm, comprising:

(A) a handle;

(B) two rings attached to said firearm, each of said two rings being positioned on an opposed side of said handle, one of said two rings including a first plurality of notches and the other of said two rings including a second plurality of notches;

(C) a locking means for preventing movement of said handle relative to said two rings, said locking means comprising:

a first locking bar movably secured to said handle, said first locking bar being separately alignable with each notch of said first plurality of notches;

means for selectively extending a portion of said first locking bar into any one notch of said first plurality of notches;

a second locking bar movably secured to said handle, said second locking bar being separately alignable with each notch of said second plurality of notches; and means for selectively extending a portion of said second locking bar into any one notch of said second plurality of notches.

8. The handle assembly according to claim 7, further including at least one distance bar connecting one of said two rings to the other of said two rings.

9. The handle assembly according to claim 7, wherein both said means for selectively extending a portion of said first locking bar and said means for selectively extending a portion of said second locking bar, comprise a spring loaded push button.

10. The handle assembly according to claim 7, said handle having a top portion with a guide member, each ring of said two rings having a guide channel therein, said guide member for placement within each guide channel of said two rings, thereby allowing said handle to be radially movable in relation to said two rings.

* * * * *